US010907791B2

(12) United States Patent
Ishiyama et al.

(10) Patent No.: US 10,907,791 B2
(45) Date of Patent: Feb. 2, 2021

(54) VEHICLE LUMINAIRE AND VEHICLE LAMP

(71) Applicant: Toshiba Lighting & Technology Corporation, Yokosuka (JP)

(72) Inventors: Masayuki Ishiyama, Yokosuka (JP); Ryuji Tsuchiya, Yokosuka (JP); Kiyokazu Hino, Yokosuka (JP); Daisuke Kosugi, Yokosuka (JP); Toshihiro Hatanaka, Yokosuka (JP); Hiromitsu Shiraishi, Yokosuka (JP); Norihiko Ochi, Yokosuka (JP); Yasuhiro Watanabe, Yokosuka (JP); Tomohiro Matsuo, Yokosuka (JP); Misaki Ueno, Yokosuka (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 16/798,720

(22) Filed: Feb. 24, 2020

(65) Prior Publication Data

US 2020/0378578 A1 Dec. 3, 2020

(30) Foreign Application Priority Data

May 29, 2019 (JP) ..... 2019-100320

(51) Int. Cl.
*F21S 43/19* (2018.01)
*F21S 43/30* (2018.01)
(Continued)

(52) U.S. Cl.
CPC ..... *F21S 43/195* (2018.01); *F21S 43/14* (2018.01); *F21S 43/30* (2018.01); *F21S 45/48* (2018.01)

(58) Field of Classification Search
CPC ..... F21S 43/195; F21S 43/30; F21S 45/48; F21S 43/14
See application file for complete search history.

(56) References Cited

U.S. PATENT DOCUMENTS

2008/0130308 A1 6/2008 Behr et al.
2009/0185381 A1* 7/2009 Willwohl ..... F21S 45/48 362/294

(Continued)

FOREIGN PATENT DOCUMENTS

CN 208735537 U 4/2019
JP 2013-247062 A 12/2013

(Continued)

*Primary Examiner* — Donald L Raleigh
(74) *Attorney, Agent, or Firm* — Banner & Witcoff, Ltd.

(57) ABSTRACT

A vehicle luminaire may include: an attachment portion which includes a concave portion opening to one end face; a light-emitting module, which includes a substrate and at least one light-emitting element provided on the substrate, provided inside the concave portion; and a plurality of bayonets provided on an outer side surface of the attachment portion. When the attachment portion is viewed from a direction along a center axis of the attachment portion, the bayonets are provided at a predetermined interval. The attachment portion includes an opening portion provided in a region between the plurality of bayonets. An opening dimension of the opening portion is larger than a width dimension of each bayonet.

19 Claims, 4 Drawing Sheets

(51) Int. Cl.
*F21S 43/14* (2018.01)
*F21S 45/48* (2018.01)

(56) References Cited

U.S. PATENT DOCUMENTS

| | | | | |
|---|---|---|---|---|
| 2015/0016136 | A1 | 1/2015 | Nakano et al. | |
| 2015/0260376 | A1* | 9/2015 | Joo | F21S 45/48 362/235 |
| 2018/0073714 | A1 | 3/2018 | Ozawa et al. | |
| 2018/0100643 | A1* | 4/2018 | Hino | F21S 45/48 |
| 2019/0267355 | A1 | 8/2019 | Ueno | |

FOREIGN PATENT DOCUMENTS

| | | | |
|---|---|---|---|
| JP | 2018-098048 | A | 6/2018 |
| WO | 2016/158423 | A1 | 10/2016 |

* cited by examiner

VEHICLE LUMINAIRE AND VEHICLE LAMP

CROSS-REFERENCE TO RELATED APPLICATIONS

This application is based upon and claims the benefit of priority from Japanese Patent Application No. 2019-100320, filed on May 29, 2019; the entire contents of which are incorporated herein by reference.

FIELD

Embodiments described herein relate generally to a vehicle luminaire and a vehicle lamp.

BACKGROUND

A vehicle luminaire including a socket and a light-emitting module provided in one end portion side of the socket is known. The light-emitting module is provided with a substrate and one surface of the substrate is provided with a light-emitting element, a resistor and other components. In such a vehicle luminaire, the light-emitting module is provided in a bottom surface of a concave portion opening to an end face of the socket. For that reason, the light-emitting module is surrounded by an inner wall surface of the concave portion and a part of light emitted from the light-emitting element is incident on the inner wall surface of the concave portion. Since a part of the light incident on the inner wall surface of the concave portion is absorbed by the inner wall surface, light extracting efficiency is deteriorated by the corresponding amount.

Here, a technique of forming a slit in an inner wall surface of a concave portion and accommodating a corner portion of a substrate inside the slit is proposed. Since there is no inner wall surface of the concave portion in a portion provided with the slit, light applied to this portion is not absorbed by the inner wall surface. However, since the slit is used to position the substrate, its width dimension needs to be small. For that reason, the light extracting efficiency cannot be improved in the slit provided in the inner wall surface of the concave portion.

Here, it is desired to develop a technique capable of improving the light extracting efficiency.

DETAILED DESCRIPTION

Figure 1:
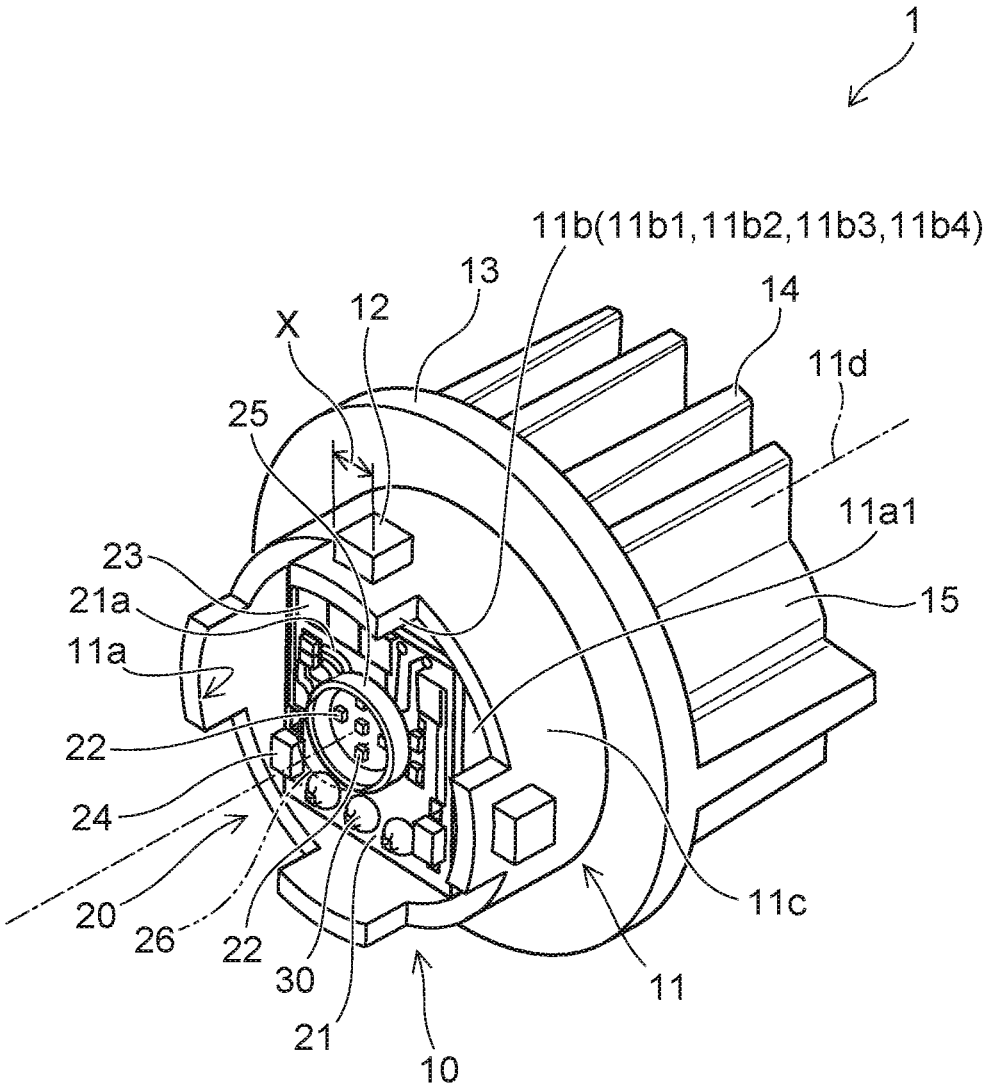
FIG. 1 is a schematic perspective view illustrating a vehicle luminaire according to an embodiment.

A vehicle luminaire according to an embodiment includes: an attachment portion which includes a concave portion opening to one end face; a light-emitting module, which includes a substrate and at least one light-emitting element provided on the substrate and is provided inside the concave portion; and a plurality of bayonets provided on an outer side surface of the attachment portion. When the attachment portion is viewed from a direction along a center axis of the attachment portion, the plurality of bayonets is provided at a predetermined interval. The attachment portion includes an opening portion provided in a region between the plurality of bayonets. An opening dimension of the opening portion is larger than a width dimension of the bayonet.

Hereinafter, embodiments will be illustrated with reference to the drawings. Additionally, in the drawings, the same elements will be denoted by the same reference numerals and a detailed description thereof will be appropriately omitted.

(Vehicle Luminaire)

A vehicle luminaire 1 according to the embodiment can be provided in, for example, automobiles and railway cars. As the vehicle luminaire 1 provided in automobiles, for example, one used in a front combination light (for example, an appropriate combination of a daytime running lamp (DRL), a position lamp, a turn signal lamp, and the like) or a rear combination light (for example, an appropriate combination of a stop lamp, a tail lamp, a turn signal lamp, a back lamp, a fog lamp, and the like) can be illustrated. However, the application of the vehicle luminaire 1 is not limited to these.

FIG. 1 is a schematic perspective view illustrating the vehicle luminaire 1 according to the embodiment.

As illustrated in FIG. 1, the vehicle luminaire 1 can be provided with a socket 10, a light-emitting module 20, and a power-supply terminal 30.

The socket 10 can be provided with an attachment portion 11, a bayonet 12, a flange 13, a thermal radiation fin 14, and a connector holder 15.

The attachment portion 11 can be provided on one surface of the flange 13. The external shape of the attachment portion 11 can be a pillar shape. The external shape of the attachment portion 11 can be, for example, a columnar shape. The attachment portion 11 can include a concave portion 11*a* opening to an end face opposite to the flange 13.

The attachment portion 11 can be provided with an opening portion 11*b*. The opening portion 11*b* can penetrate between an inner wall surface of the concave portion 11*a* and an outer side surface 11*c* of the attachment portion 11. Further, the opening portion 11*b* can open to an end face opposite to a bottom surface 11*a*1 of the concave portion 11*a* in the attachment portion 11 (an end face opposite to the flange 13 in the attachment portion 11).

When the attachment portion 11 is viewed from a direction along a center axis 11*d* of the attachment portion 11, a plurality of bayonets 12 can be provided at a predetermined interval. The attachment portion 11 can include the opening portion 11*b* provided in a region between the plurality of bayonets 12. That is, the opening portion 11*b* can be provided between the bayonet 12 and the bayonet 12 in the circumferential direction of the attachment portion 11. The attachment portion 11 illustrated in FIG. 1 is provided with four opening portions 11*b*, that is, opening portions 11*b*1, 11*b*2, 11*b*3, and 11*b*4. Additionally, at least one opening portion 11*b* may be provided. However, it is easy to improve the light extracting efficiency when the opening portion 11*b* is provided between each of the plurality of bayonets 12.

Additionally, the opening portion 11*b* will be described in detail later.

The bayonet 12 can be provided at a plurality of positions of the outer side surface 11*c* of the attachment portion 11.

The plurality of bayonets 12 can protrude toward the outside of the vehicle luminaire 1. The plurality of bayonets 12 can face the flange 13. The plurality of bayonets 12 can be used when attaching the vehicle luminaire 1 to a casing 101 of a vehicle lamp 100. The plurality of bayonets 12 can be used for twist lock.

The flange 13 can have a plate shape. For example, the flange 13 can have a disk shape. The outer side surface of the flange 13 can be located at the outside of the vehicle luminaire 1 in relation to the outer side surface of the bayonet 12.

The thermal radiation fin 14 can be provided on the side opposite to the attachment portion 11 in the flange 13. At least one thermal radiation fin 14 can be provided. Additionally, the socket 10 illustrated in FIG. 1 is provided with a plurality of the thermal radiation fins 14. The plurality of thermal radiation fins 14 can be provided side by side in a predetermined direction. The thermal radiation fin 14 can have a plate shape.

The connector holder 15 can be provided on the side opposite to the attachment portion 11 in the flange 13. The connector holder 15 can have a cylindrical shape. A connector 105 including a seal member 105*a* is inserted into the connector holder 15. For that reason, the cross-sectional shape of the hole of the connector holder 15 can be suitable for the cross-sectional shape of the connector 105 including the seal member 105*a*.

Heat generated in the light-emitting module 20 is mainly transmitted to the thermal radiation fin 14 through the attachment portion 11 and the flange 13. The heat transmitted to the thermal radiation fin 14 can be mainly discharged from the thermal radiation fin 14 to the outside. For that reason, the socket 10 is desirably formed of a material having high thermal conductivity in consideration of the transmission of the heat generated in the light-emitting module 20 to the outside. The material having high thermal conductivity can be, for example, metal such as aluminum.

Further, in recent years, a decrease in weight of the vehicle luminaire 1 is desired. For that reason, the socket 10 is desirably formed using a high thermal conductive resin. The high thermal conductive resin can be obtained by mixing a filler using an inorganic material with a resin such as polyethylene terephthalate (PET) or Nylon. The inorganic material can be, for example, ceramics such as aluminum oxide or carbon.

Further, a part of the elements constituting the socket 10 can be formed using metal and the remaining elements can be formed using a high thermal conductive resin.

However, when the socket 10 is formed using a high thermal conductive resin, heat generated in the light-emitting module 20 can be effectively radiated. Further, the weight of the vehicle luminaire 1 can be decreased. In this case, the attachment portion 11, the bayonet 12, the flange 13, the thermal radiation fin 14, and the connector holder 15 can be integrally formed using an injection-molding method or the like.

The light-emitting module 20 can be provided inside the concave portion 11*a*.

The light-emitting module 20 (substrate 21) can be bonded to the bottom surface 11*a*1 of the concave portion 11*a*. In this case, an adhesive is desirably an adhesive having high thermal conductivity. For example, the adhesive can be an adhesive mixed with a filler using an inorganic material. The inorganic material is desirably a material having high thermal conductivity (for example, ceramics such as aluminum oxide and aluminum nitride). The thermal conductivity of the adhesive can be, for example, 0.5 W/(m·K) or more and 10 W/(m·K) or less.

Further, the light-emitting module 20 (the substrate 21) can also be provided on the bottom surface 11*a*1 of the concave portion 11*a* with a layer formed of thermal conductive grease (radiation grease) interposed therebetween. The type of thermal conductive grease is not particularly limited, but may be one obtained by mixing, for example, modified silicone with a filler using a material having high thermal conductivity (for example, ceramics such as aluminum oxide or aluminum nitride). The thermal conductivity of the thermal conductive grease can be, for example, 1 W/(m·K) or more and 5 W/(m·K) or less.

Further, a heat transfer portion can be provided between the light-emitting module 20 (the substrate 21) and the bottom surface 11*a*1 of the concave portion 11*a*. For example, the heat transfer portion can have a plate shape and be formed of metal such as aluminum, aluminum alloy, copper, and copper alloy. For example, the heat transfer portion can be bonded to the bottom surface 11*a*1 of the concave portion 11*a* using the adhesive having high thermal conductivity, embedded in the bottom surface 11*a*1 of the concave portion 11*a* using an insert-molding method, or attached to the bottom surface 11*a*1 of the concave portion 11*a* through the thermal conductive grease.

The light-emitting module 20 can include a substrate 21, a light-emitting element 22, a resistor 23, and a control element 24.

The substrate 21 can have a plate shape. The planar shape of the substrate 21 can be, for example, a square. The material or structure of the substrate 21 is not particularly limited. For example, the substrate 21 can be formed of an inorganic material such as ceramics (for example, aluminum oxide or aluminum nitride) or an organic material such as paper phenol or glass epoxy. Further, the substrate 21 may be a metal plate of which a surface is coated with an insulating material. In addition, when the surface of the metal plate is coated with an insulating material, the insulating material may be an organic material or an inorganic material. When the amount of heat of the light-emitting element 22 is large, the substrate 21 is desirably formed using a material having high thermal conductivity from the viewpoint of the heat radiation. As the material having high thermal conductivity, for example, ceramics such as aluminum oxide and aluminum nitride, high thermal conductive resin, and a metal plate whose surface is coated with an insulating material can be illustrated. Further, the substrate 21 may have a single layer structure or a multilayer structure.

Further, a wiring pattern 21*a* can be provided on the surface opposite to the bottom surface 11*a*1 of the concave portion 11*a* in the substrate 21. The wiring pattern 21*a* can be formed of, for example, a material mainly including silver or a material mainly including copper.

The light-emitting element 22 can be provided on the substrate 21. The light-emitting element 22 can be electrically connected to the wiring pattern 21*a* provided on the surface of the substrate 21. At least one light-emitting element 22 can be provided. In the case of the vehicle luminaire 1 illustrated in FIG. 1, five light-emitting elements 22 are provided. When the plurality of light-emitting elements 22 are provided, the plurality of light-emitting elements 22 can be connected in series to each other. Further, the light-emitting element 22 can be connected in series to the resistor 23.

The light-emitting element 22 can be, for example, a light-emitting diode, an organic light-emitting diode, a laser diode, or the like.

The light-emitting element 22 may be a chip-shaped light-emitting element, a surface mounted light-emitting element, or a shell type light-emitting element having a lead wire. However, the chip-shaped light-emitting element is desirable in consideration of a decrease in size of the substrate 21 and further a decrease in size of the vehicle luminaire 1. Additionally, the light-emitting element 22 illustrated in FIG. 1 is a chip-shaped light-emitting element.

The chip-shaped light-emitting element 22 can be mounted on the wiring pattern 21*a* by Chip On Board (COB). When the light-emitting element 22 is a light-emitting element of an upper and lower electrode type or a light-emitting element of an upper electrode type, the light-emitting element 22 can be electrically connected to the wiring pattern 21*a* by, for example, a wire bonding method. When the light-emitting element 22 is a flip chip type light-emitting element, the light-emitting element 22 can be directly connected to the wiring pattern 21*a*.

The number, size, arrangement, and the like of the light-emitting elements 22 are not limited to those illustrated and can be appropriately changed in response to the size, application, or the like of the vehicle luminaire 1.

The resistor 23 can be provided on the substrate 21. The resistor 23 can be electrically connected to the wiring pattern 21*a* provided on the surface of the substrate 21. The resistor 23 can be, for example, a surface mounted resistor, a resistor (metal oxide film resistor) having a lead wire, a film-shaped resistor formed using a screen printing method, or the like. Additionally, the resistor 23 illustrated in FIG. 1 is a film-shaped resistor.

As a material of the film-shaped resistor, for example, ruthenium oxide ($RuO_2$) can be used. The film-shaped resistor can be formed using, for example, a screen printing method and a baking method. If the resistor 23 is the film-shaped resistor, the contact area between the resistor 23 and the substrate 21 can be large and hence thermal radiation performance can be improved. Further, the plurality of resistors 23 can be formed at one time. For that reason, productivity can be improved. Further, it is possible to suppress a variation in the resistance value of the plurality of resistors 23.

Here, since there is a variation in the forward voltage characteristic of the light-emitting element 22, the brightness (light flux, luminance, luminous intensity, illuminance) of the light emitted from the light-emitting element 22 varies when the voltage applied between the anode terminal and the ground terminal is kept constant. For that reason, the value of the current flowing to the light-emitting element 22 can be set within a predetermined range by the resistor 23 so that the brightness of the light emitted from the light-emitting element 22 falls into a predetermined range. In this case, the value of the current flowing to the light-emitting element 22 can be set within a predetermined range by changing the resistance value of the resistor 23.

When the resistor 23 is a surface mounted resistor or a resistor with a lead wire, the resistor 23 having an appropriate resistance value in response to the forward voltage characteristics of the light-emitting element 22 can be selected. When the resistor 23 is a film-shaped resistor, the resistance value can be increased if a part of the resistor 23 is removed. For example, when the resistor 23 is irradiated with a laser beam, a part of the resistor 23 can be easily removed. The number, size, arrangement, and the like of the resistors 23 are not limited to those illustrated and can be appropriately changed in response to the number, specifications, and the like of the light-emitting elements 22.

The control element 24 can be provided on the substrate 21. The control element 24 can be electrically connected to the wiring pattern 21*a*. The control element 24 can be provided so that a reverse voltage is not applied to the light-emitting element 22 and a pulse noise is not applied to the light-emitting element 22 from a reverse direction. The control element 24 can be, for example, a diode. The control element 24 can be, for example, a surface mounted diode or a diode including a lead wire. The control element 24 illustrated in FIG. 1 is a surface mounted diode.

In addition, a pull-down resistor can also be provided in order to detect continuity for the light-emitting element 22 and prevent erroneous lighting. Further, a covering portion that covers the wiring pattern 21*a* or the film-shaped resistor can be provided. The covering portion can include, for example, a glass material.

When the light-emitting element 22 is the chip-shaped light-emitting element, the light-emitting module 20 can further include a frame 25 and a sealing portion 26.

The frame 25 can be bonded onto the substrate 21. The frame 25 can have a frame shape. At least one light-emitting element 22 can be provided in a region surrounded by the frame 25. For example, the frame 25 can surround the plurality of light-emitting elements 22. The frame 25 can be formed of a resin. The resin can be, for example, a thermoplastic resin such as polybutylene terephthalate (PBT), polycarbonate (PC), PET, Nylon, polypropylene (PP), polyethylene (PE), and polystyrene (PS).

Further, it is possible to improve the reflectance of the light emitted from the light-emitting element 22 by mixing particles of titanium oxide or the like in the resin. Additionally, the embodiment is not limited to the particles of titanium oxide and particles of a material having high reflectance with respect to the light emitted from the light-emitting element 22 may be mixed. Further, the frame 25 can be formed of, for example, a white resin. That is, the frame 25 can have a function of defining the formation range of the sealing portion 26 and a function of the reflector.

Additionally, a case in which the frame 25 is molded using an injection-molding method or the like and the molded frame 25 is bonded to the substrate 21 is illustrated, but the embodiment is not limited thereto. For example, the frame 25 can also be formed by applying a dissolved resin in a frame shape on the substrate 21 using a dispenser or the like and curing the resin.

Further, the frame 25 can be omitted. When the frame 25 is omitted, the dome-shaped sealing portion 26 covering the light-emitting element 22 can be provided. Additionally, when the frame 25 is provided, the formation range of the sealing portion 26 can be defined. For that reason, since it is possible to suppress an increase in the planar dimension of the sealing portion 26, it is possible to decrease the size of the substrate 21 and further decrease the size of the vehicle luminaire 1.

The sealing portion 26 can be provided in a region surrounded by the frame 25. The sealing portion 26 can be provided so as to cover the region surrounded by the frame 25. The sealing portion 26 can be provided so as to cover the light-emitting element 22. The sealing portion 26 can be formed of a material having translucency. For example, the sealing portion 26 can be formed by filling a resin into the region surrounded by the frame 25. The filling of the resin can be performed by, for example, liquid dispensing equipment such as a dispenser. The resin to be filled can be, for example, a silicone resin. Further, the sealing portion 26 can include a phosphor. The phosphor can be, for example, a YAG phosphor (yttrium.aluminum.garnet phosphor). However, the type of the phosphor can be appropriately changed so that a predetermined emission color can be obtained according to the application of the vehicle luminaire 1 or the like.

Additionally, when the light-emitting element 22 is a surface mounted light-emitting element or a shell type light-emitting element having a lead wire, the frame 25 and the sealing portion 26 can be omitted. However, as described above, the light-emitting element 22 is desirably the chip-shaped light-emitting element and the frame 25 and the sealing portion 26 are desirably provided in consideration of a decrease in size of the substrate 21.

A plurality of the power-supply terminals 30 can be provided. The plurality of power-supply terminals 30 can be provided inside the socket 10. The plurality of power-supply terminals 30 can be bar-shaped bodies. The plurality of power-supply terminals 30 can protrude from the bottom surface 11*a*1 of the concave portion 11*a* and be soldered to the wiring pattern 21*a* provided on the substrate 21. An end portion on the side of the thermal radiation fin 14 of the plurality of power-supply terminals 30 can be exposed into the connector holder 15. The connector 105 can be fitted to the plurality of power-supply terminals 30 exposed into the connector holder 15. The plurality of power-supply terminals 30 can be formed of, for example, metal such as a copper alloy. Additionally, the number, shape, arrangement, material, and the like of the power-supply terminals 30 are not limited to those illustrated, but can be appropriately changed.

As described above, the socket 10 is desirably formed of a material having high thermal conductivity. Incidentally, the material having high thermal conductivity may have electrical conductivity. For example, a metal or a high thermal conductive resin including a filler formed of carbon has conductivity. For that reason, an insulation portion can be provided between the plurality of power-supply terminals 30 and the socket 10 in the case of the socket 10 having conductivity. Additionally, when the socket 10 is formed of a high thermal conductive resin having insulation properties (for example, a high thermal conductive resin or the like including a ceramic filler), the insulation portion can be omitted. In this case, the socket 10 holds the plurality of power-supply terminals 30.

Next, the opening portion 11*b* provided in the attachment portion 11 will be described further.

As illustrated in FIG. 1, the upper surface (the light emission surface) of the light-emitting element 22 faces the front surface side of the vehicle luminaire 1. For that reason, the light-emitting element 22 mainly emits light toward the front surface side of the vehicle luminaire 1. However, the light emitted from the light-emitting element 22 is partially applied to the inner wall side of the concave portion 11*a*. In this case, when the light is incident on the inner wall surface of the concave portion 11*a*, a part of the incident light is not reflected, but is absorbed by the inner wall surface. Since the light absorbed by the inner wall surface cannot be extracted to the outside of the vehicle luminaire 1, the light extracting efficiency is deteriorated by the corresponding amount.

Here, the vehicle luminaire 1 according to the embodiment is provided with the attachment portion 11 having the opening portion 11*b*. As described above, the opening portion 11*b* penetrates between the inner wall surface of the concave portion 11*a* and the outer side surface 11*c* of the attachment portion 11. For that reason, the light applied to the opening portion 11*b* is not absorbed by the inner wall surface of the concave portion 11*a* and is applied to the outside of the vehicle luminaire 1 through the opening portion 11*b*. That is, the light extracting efficiency can be improved. Since the light applied to the outside of the vehicle luminaire 1 through the opening portion 11*b* can be incident on, for example, an optical element 103 provided in the vehicle lamp 100, the light can be effectively used.

Here, when the opening portion 11*b* is enlarged, the amount of the light that can be extracted to the outside of the vehicle luminaire 1 can be increased. For example, when the attachment portion 11 is viewed from a direction along the center axis 11*d* of the attachment portion 11, the opening dimension of the opening portion 11*b* can be larger than the width dimension X of the bayonet 12. The width dimension X of the bayonet 12 can be the dimension of the bayonet 12 in the circumferential direction of the attachment portion 11 when the attachment portion 11 is viewed from a direction along the center axis 11*d* of the attachment portion 11.

Here, the bayonet 12 is used when attaching the vehicle luminaire 1 to the casing 101 of the vehicle lamp 100. For that reason, when the opening portion 11*b* is too large, the strength of the attachment portion 11 is lowered. Accordingly, there is concern that the attachment portion 11 may be damaged or the position of the vehicle luminaire 1 is shifted.

For that reason, a ratio of the opening portion 11*b* occupying the outer side surface 11*c* of the attachment portion 11 is desirably within a predetermined range.

Figure 2A:
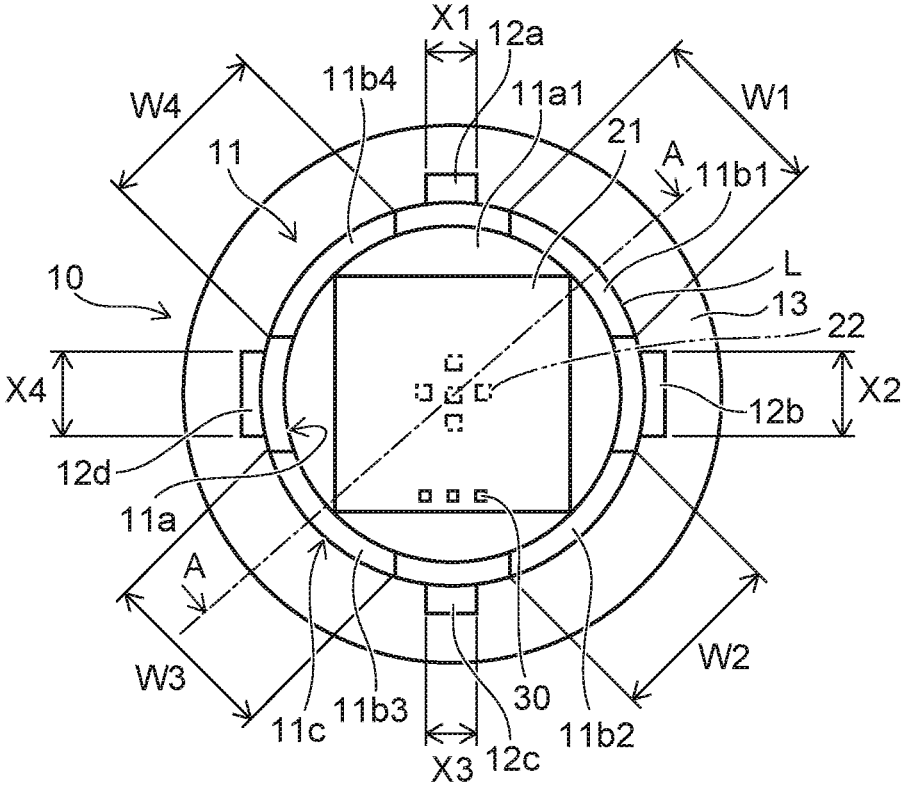
FIG. 2A is a schematic front view illustrating an attachment portion with four opening portions and FIG. 2B is a cross-sectional view taken along a line A-A of a socket of FIG. 2A.

FIG. 2A is a schematic front view illustrating the attachment portion 11 including the four opening portions 11*b*1 to 11*b*4.

Additionally, in FIG. 2A, the elements provided on the substrate 21 are omitted in order to avoid complication. Further, in FIG. 2A, since four bayonets 12*a* to 12*d* are provided, the width dimensions of the four bayonets 12*a* to 12*d* are respectively set to X1, X2, X3, and X4.

Figure 2B:
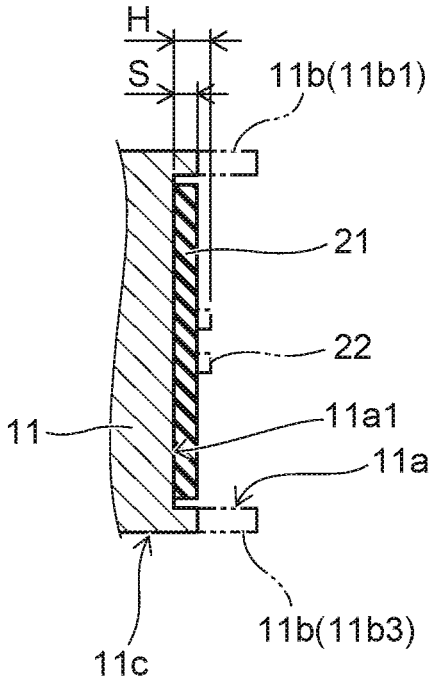

FIG. 2B is a cross-sectional view taken along a line A-A of the socket 10 in FIG. 2A.

Table 1 is a table illustrating a relationship of the ratio of the opening portion 11*b* occupying the outer side surface 11*c* of the attachment portion 11, the strength of the attachment portion 11, and the light extracting efficiency.

TABLE 1

| K | Strength of attachment portion | Light extracting efficiency | Determination |
|---|---|---|---|
| 0.1 | X | ○ | X |
| 0.15 | X | ○ | X |
| 0.2 | ○ | ○ | ○ |
| 0.3 | ○ | ○ | ○ |
| 0.4 | ○ | ○ | ○ |
| 0.5 | ○ | X | X |
| 0.6 | ○ | X | X |
| 0.7 | ○ | X | X |

Additionally, in Table 1, the "ratio of the opening portion 11*b* occupying the outer side surface 11*c* of the attachment portion 11" is the "ratio K of the total value W of the opening dimensions of the plurality of opening portions 11*b* with respect to the outer peripheral dimension L of the attachment portion 11 when the attachment portion 11 is viewed from a direction along the center axis 11*d* of the attachment portion 11".

For example, in the case of the attachment portion 11 illustrated in FIG. 2A, the outer peripheral dimension of the attachment portion 11 is set to L and the opening dimensions of four opening portions 11*b*1 to 11*b*4 are respectively set to W1, W2, W3, and W4. In this case, the opening dimensions W1, W2, W3, and W4 can be set to the dimension of the opening portion in the outer side surface 11*c* of the attachment portion 11.

Further, in the "strength of the attachment portion" of Table 1, a case without the damage or deformation of the attachment portion 11 is indicated by "○" and a case with the damage or deformation is indicated by "x" when the vehicle luminaire 1 is attached to the casing 101 about twenty times.

In the "light extracting efficiency" of Table 1, a case in which the light extracting efficiency is improved by 1.5% or more is indicated by "○" and a case in which the light extracting efficiency is improved by less than 1.5% is indicated by "x" when the opening portion 11*b* is provided.

In the case of the attachment portion 11 illustrated in FIG. 2A, since the outer peripheral dimension of the attachment portion 11 is L and the total value of the opening dimensions of the plurality of opening portions 11*b* (11*b*1 to 11*b*4) is "W=W1+W2+W3+W4", "K" can be expressed as below.

$$K=W/L$$

Additionally, the unit of the outer peripheral dimension L and the opening dimensions W, W1, W2, W3, and W4 can be "mm (millimeter)".

As understood from Table 1, in the case of "$0.2 \leq K \leq 0.4$", the light extracting efficiency can be improved and the strength of the attachment portion 11 can be suppressed from becoming too low.

Further, as illustrated in FIG. 2B, a distance S between the bottom surface 11*a*1 of the concave portion 11*a* and the end portion on the side of the bottom surface 11*a*1 in the opening portion 11*b* can be set to be smaller than a distance H between the bottom surface 11*a*1 of the concave portion 11*a* and the upper surface of the light-emitting element 22. Since light is mainly emitted from the upper surface of the light-emitting element 22, it is possible to suppress light from being incident on the inner wall surface of the concave portion 11*a* in such a positional relationship. Further, since the inner wall surface of the concave portion 11*a* can be left in a region provided with the opening portion 11*b*, it is easy to suppress the strength of the attachment portion 11 from becoming too low.

Further, the distance S can be set to be smaller than the distance between the bottom surface 11*a*1 of the concave portion 11*a* and the surface provided with the light-emitting element 22 in the substrate 21. In this way, it is further easy to suppress light from being incident on the inner wall surface of the region provided with the opening portion 11*b*.

Further, the bottom surface 11*a*1 of the concave portion 11*a* and the end portion on the side of the bottom surface 11*a*1 in the opening portion 11*b* can be provided at the same position in a direction along the center axis 11*d* of the attachment portion 11. That is, the distance S can be set to be 0 (zero). In this way, the corner portion of the substrate 21 can be accommodated in the opening portion 11*b*. For that reason, since the outer diameter dimension of the attachment portion 11 can be small, the vehicle luminaire 1 can be decreased in size. Alternatively, since the planar dimension of the substrate 21 can be large, it is easy to increase the number of elements provided on the substrate 21, to provide a large size element, or to increase the number of types of elements.

Additionally, when the distance S is set to be small, the incidence of light to the inner wall surface can be easily suppressed, but the strength of the attachment portion 11 is deteriorated. In this case, when a high-strength material is used, necessary strength can be secured even when the distance S is small. For that reason, the distance S can be appropriately determined in response to the required light extracting efficiency, the required strength of the attachment portion 11, the required miniaturization of the vehicle luminaire 1, and the like.

FIGS. 3A to 3F are schematic cross-sectional views illustrating the vicinity of the end face in which the concave portion 11*a* opens in the attachment portion 11 (the vicinity of the front end of the attachment portion 11).

As illustrated in FIGS. 3A to 3F, an end portion in which the concave portion 11*a* opens in the attachment portion 11 can be thinned as it goes toward the front end side.

Figure 3A:
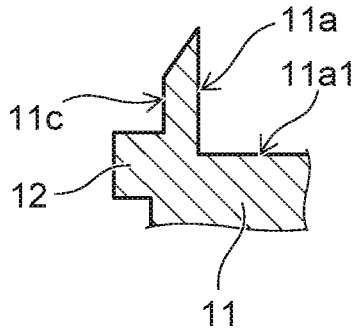
FIGS. 3A to 3F are schematic cross-sectional views illustrating the vicinity of an end face having a concave portion opening thereto (the vicinity of a front end of the attachment portion) in the attachment portion.
Figure 3B:
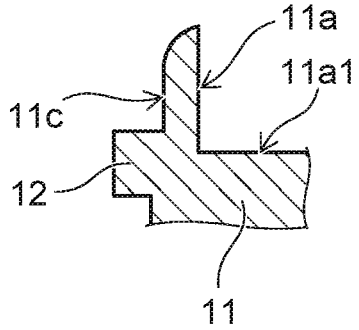

For example, as illustrated in FIGS. 3A and 3B, the outer side surface 11*c* in the vicinity of the front end of the attachment portion 11 can be inclined in a direction moving closer to the center axis 11*d* as it goes toward the front end side of the attachment portion 11. In this case, a planar inclined surface can be used as illustrated in FIG. 3A or a curved inclined surface can be used as illustrated in FIG. 3B.

Figure 3C:
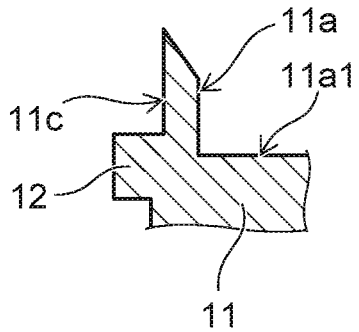
Figure 3E:
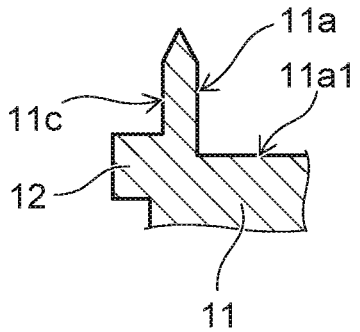
Figure 3D:
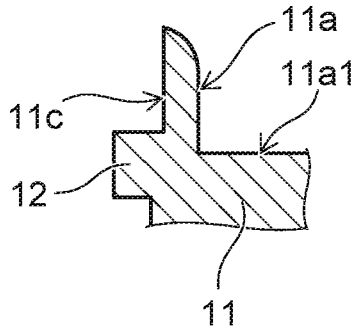

Further, for example, as illustrated in FIGS. 3C and 3D, the inner side surface in the vicinity of the front end of the attachment portion 11 (the inner wall surface of the concave portion 11*a*) can be inclined in a direction moving away from the center axis 11*d* as it goes toward the front end side of the attachment portion 11. In this case, a planar inclined surface can be used as illustrated in FIG. 3C or a curved inclined surface can be used as illustrated in FIG. 3D.

Figure 3F:
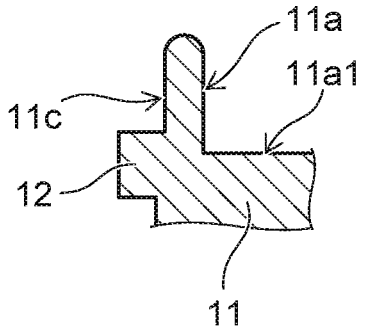

Further, for example, as illustrated in FIGS. 3E and 3F, the inclined surface can be provided in the outer side surface 11*c* and the inner side surface in the vicinity of the front end of the attachment portion 11.

In this case, when the inclined surface is provided in the outer side surface 11*c* in the vicinity of the front end of the attachment portion 11, it is easy to insert the vehicle luminaire 1 into an attachment hole 101*a* of the casing 101.

When the inclined surface is provided in the inner side surface in the vicinity of the front end of the attachment portion 11, the light-emitting module 20 can be easily inserted into the concave portion 11*a*. Further, it is easy to insert soldering iron into the concave portion 11*a* at the time of soldering the plurality of power-supply terminals 30 to the wiring pattern 21*a*.

(Vehicle Lamp)

Next, the vehicle lamp 100 will be illustrated.

Additionally, hereinafter, a case in which the vehicle lamp 100 is a front combination light provided in an automobile will be described as an example. However, the vehicle lamp 100 is not limited to the front combination light provided in the automobile. The vehicle lamp 100 may be a vehicle lamp provided in an automobile, a railway car or the like.

Figure 4:
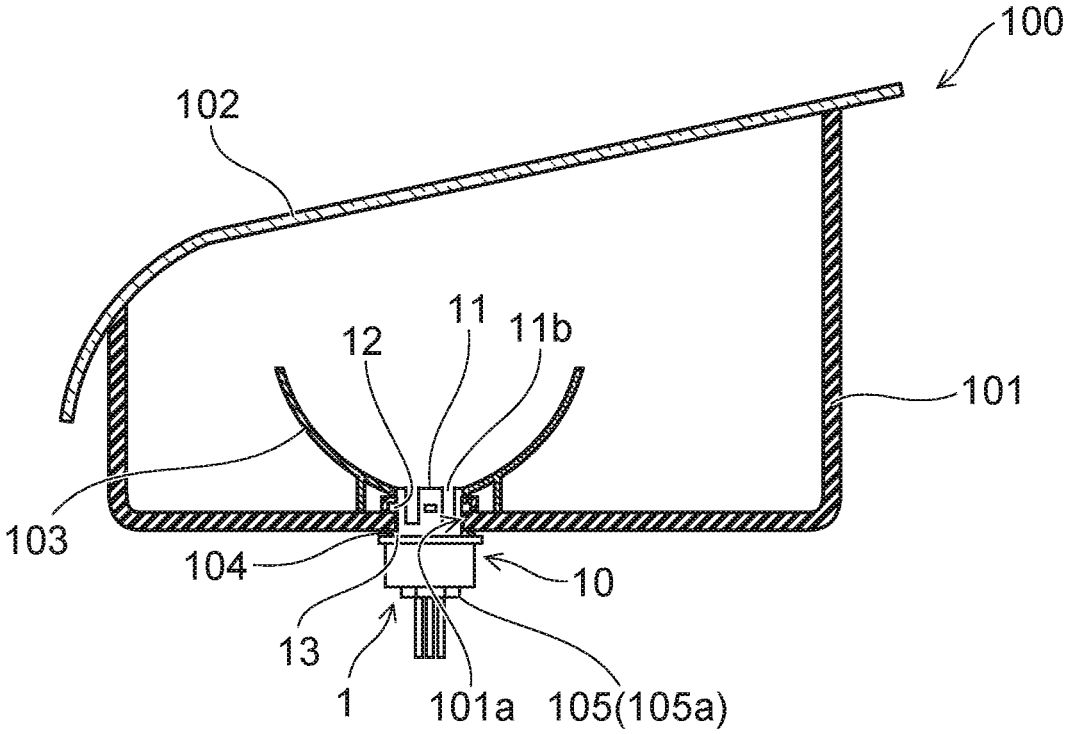
FIG. 4 is a partially cross-sectional view schematically illustrating a vehicle lamp.

FIG. 4 is a partially cross-sectional view schematically illustrating the vehicle lamp 100.

As illustrated in FIG. 4, the vehicle lamp 100 can be provided with the vehicle luminaire 1, the casing 101, a cover 102, an optical element 103, a seal member 104, and the connector 105.

The vehicle luminaire 1 can be attached to the casing 101. The casing 101 can hold the attachment portion 11. The casing 101 can have a box shape of which one end portion side is opened. The casing 101 can be formed of, for example, a resin that does not transmit light. The bottom surface of the casing 101 can be provided with the attachment hole 101*a* into which a portion provided with the bayonet 12 is inserted in the attachment portion 11. The peripheral edge of the attachment hole 101*a* can be provided with a concave portion into which the bayonet 12 provided on the attachment portion 11 is inserted. Additionally, a case in which the attachment hole 101*a* is directly provided in the casing 101 is illustrated, but an attachment member with the attachment hole 101*a* may be provided in the casing 101.

At the time of attaching the vehicle luminaire 1 to the vehicle lamp 100, a portion provided with the bayonet 12 on the attachment portion 11 is inserted into the attachment hole 101*a* and the vehicle luminaire 1 is rotated. Then, for example, the bayonet 12 is held by a fitting portion provided in the peripheral edge of the attachment hole 101*a*. Such an attachment method is called a twist lock.

The cover 102 can be provided so as to block the opening of the casing 101. The cover 102 can be formed of a resin having translucency. The cover 102 can have a function of a lens or the like.

Light emitted from the vehicle luminaire 1 is incident on the optical element 103. The optical element 103 can perform at least one of a reflecting operation, a diffusing operation, a guiding operation, a collecting operation, and a predetermined light distribution pattern forming operation of the light emitted from the vehicle luminaire 1. For example, the optical element 103 illustrated in FIG. 4 is a reflector. In this case, the optical element 103 can form a predetermined light distribution pattern by reflecting light emitted from the vehicle luminaire 1.

The seal member 104 can be provided between the flange 13 and the casing 101. The seal member 104 can have an annular shape. The seal member 104 can be formed of an elastic material such as rubber or silicone resin.

When the vehicle luminaire 1 is attached to the vehicle lamp 100, the seal member 104 is sandwiched between the flange 13 and the casing 101. For that reason, the internal space of the casing 101 can be sealed by the seal member 104. Further, the bayonet 12 is pressed against the casing 101 by the elastic force of the seal member 104. For that reason, it is possible to suppress the vehicle luminaire 1 from being separated from the casing 101.

The connector 105 can be fitted to the end portions of the plurality of power-supply terminals 30 exposed into the connector holder 15. A power supply (not illustrated) or the like can be electrically connected to the connector 105. For that reason, the light-emitting element 22 can be electrically connected to a power supply (not illustrated) or the like by fitting the connector 105 to the end portion of the power-supply terminal 30. Further, the inside of the connector holder 15 is sealed so as to be watertight in such a manner that the connector 105 with the seal member 105*a* is inserted into the connector holder 15. The seal member 105*a* can be formed in an annular shape from an elastic material such as rubber or silicone resin.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle luminaire comprising:

an attachment portion which includes a concave portion opening to one end face;

a light-emitting module, which includes a substrate and at least one light-emitting element provided on the substrate, provided inside the concave portion; and a plurality of bayonets provided on an outer side surface of the attachment portion, wherein when the attachment portion is viewed from a direction along a center axis of the attachment portion, the plurality of bayonets is provided at a predetermined interval, the attachment portion includes an opening portion provided in a region between the plurality of bayonets, and an opening dimension of the opening portion is larger than a width dimension of each bayonet, and the opening portion penetrates between an inner wall surface of the concave portion and an outer side surface of the attachment portion and opens to an end face opposite to a bottom surface of the concave portion in the attachment portion.

2. A vehicle lamp comprising:

the vehicle luminaire according to claim 1; and a casing to which the vehicle luminaire is attached.

3. The luminaire according to claim 1, wherein the opening portion is one of a plurality of opening portions, and wherein one of the plurality of opening portions is provided between each of the bayonets in a circumferential direction of the attachment portion.

4. The luminaire according to claim 1, wherein the opening portion is one of a plurality of opening portions, and wherein when the attachment portion is viewed from a direction along the center axis of the attachment portion, the following equation is satisfied on the assumption that an outer peripheral dimension of the attachment portion is L (mm) and a total value of opening dimensions of the plurality of opening portions is W (mm):

$$0.2 \leq W/L \leq 0.4.$$

5. The luminaire according to claim 1, wherein a distance between a bottom surface of the concave portion and an end portion on a side of the bottom surface in the opening portion is smaller than a distance between the bottom surface of the concave portion and an upper surface of the light-emitting element.

6. The luminaire according to claim 1, wherein a distance between a bottom surface of the concave portion and an end portion on a side of the bottom surface in the opening portion is smaller than a distance between the bottom surface of the concave portion and a surface provided with the light-emitting element in the substrate.

7. The luminaire according to claim 1, wherein a bottom surface of the concave portion and an end portion on a side of the bottom surface in the opening portion are located at the same position in a direction along the center axis of the attachment portion.

8. The luminaire according to claim 7, wherein a corner portion of the substrate is accommodated inside the opening portion.

9. The luminaire according to claim 1, wherein an end portion having the concave portion opening thereto in the attachment portion is thinned as it goes toward a front end side.

10. The luminaire according to claim 1, wherein an outer side surface in the vicinity of a front end of the attachment portion is inclined in a direction moving closer to the center axis of the attachment portion as it goes toward a front end side of the attachment portion.

11. The luminaire according to claim 1, wherein an inner side surface in the vicinity of a front end of the attachment portion is inclined in a direction moving away from the center axis of the attachment portion as it goes toward a front end side of the attachment portion.

12. The luminaire according to claim 1, wherein an outer side surface in the vicinity of a front end of the attachment portion is inclined in a direction moving closer to the center axis of the attachment portion as it goes toward a front end side of the attachment portion, and an inner side surface in the vicinity of the front end of the attachment portion is inclined in a direction moving away from the center axis of the attachment portion as it goes toward the front end side of the attachment portion.

13. The luminaire according to claim 1, wherein each bayonet is provided at four positions, the opening portion is one of a plurality of opening portions, and one opening portion is provided between each of the bayonets.

14. The luminaire according to claim 1, wherein a plurality of chip-shaped light-emitting elements are provided in a center region of the substrate, and light from the plurality of light-emitting elements is partially applied to the outside of the vehicle luminaire through the opening portion.

15. The luminaire according to claim 14, further comprising a frame which is provided on the substrate and surrounds the plurality of light-emitting elements.

16. The luminaire according to claim 15, further comprising a sealing portion which is provided in a region surrounded by the frame and covers the plurality of light-emitting elements.

17. The luminaire according to claim 16, wherein the sealing portion includes a resin having translucency and a phosphor.

18. The luminaire according to claim 1, wherein the attachment portion and the plurality of bayonets are integrally formed and include a high thermal conductive resin.

19. The lamp according to claim 2, further comprising an optical element on which light applied from the vehicle luminaire is to be incident, wherein the vehicle luminaire is provided with an attachment portion with a plurality of opening portions including the opening portion, and light applied to the outside of the vehicle luminaire through the opening portions is incident on the optical element.

* * * * *